United States Patent [19]

Voegelin

[11] 4,144,428

[45] Mar. 13, 1979

[54] ELECTRICAL SWITCH WITH LEAF SPRING SWITCHING ELEMENT

[75] Inventor: Howard J. Voegelin, Cheshire, Conn.

[73] Assignee: Veeder Industries Inc., Hartford, Conn.

[21] Appl. No.: 751,059

[22] Filed: Dec. 16, 1976

[51] Int. Cl.[2] ..... H01H 3/12; H01H 13/14; H01H 13/64

[52] U.S. Cl. ..... 200/159 A; 200/67 D; 200/283

[58] Field of Search ..... 200/159 A, 292, 67 D, 200/67 DA, 16 D, 283, 295

[56] References Cited

U.S. PATENT DOCUMENTS 3,749,872 7/1973 Foster ..... 200/292

FOREIGN PATENT DOCUMENTS

S883 6/1956 Fed. Rep. of Germany ..... 200/159 A
1540284 1/1970 Fed. Rep. of Germany ..... 200/159 A
53017 9/1933 Norway ..... 200/159 A
1440250 6/1976 United Kingdom ..... 200/159 A

*Primary Examiner*—Harold J. Tudor
*Attorney, Agent, or Firm*—Prutzman, Kalb, Chilton & Alix

[57] ABSTRACT

A printed circuit board switch with a generally U-shaped frame with reduced end tangs soldered within apertures of a printed circuit board, a leaf spring switch element mounted between the legs of the frame and a reciprocable switch operating rod mounted on the frame parallel to the printed circuit board for bowing the leaf spring switch element into engagement with an electrical contact of the printed circuit board.

6 Claims, 4 Drawing Figures

ELECTRICAL SWITCH WITH LEAF SPRING SWITCHING ELEMENT

BRIEF SUMMARY OF THE INVENTION

The present invention relates generally to electrical switches of the type having a leaf spring switching element.

It is a primary aim of the present invention to provide a new and improved electrical switch of the type described having notable utility as a printed circuit board switch for making and braking electrical connection between printed circuit conductors of the printed circuit board.

It is another aim of the present invention to provide a new and improved switch of the type described which may be readily installed on a PC board or the like.

It is another aim of the present invention to provide in an electrical switch of the type having a leaf spring switching element a new and improved arrangement for flexing the leaf spring for making and braking electrical connection with a cooperating electrical contact. In accordance with the present invention, the leaf spring switching element is flexed to displace a contact thereof into electrical engagement with a cooperating electrical contact along a sloping path and with contact force providing a good electrical connection.

It is another aim of the present invention to provide in an electrical switch of the type having a leaf spring switching element, a new and improved orientation of parts for actuating the leaf spring switching element so that a contact thereof makes electrical contact with a cooperating fixed contact through sliding engagement.

It is a further aim of the present invention to provide a new and improved electrical switch of the type described having a compact and economical assembly.

Other objects will be in part obvious and in part pointed out more in detail hereinafter.

A better understanding of the invention will be obtained from the following detailed description and the accompanying drawing of an illustrative application of the invention.

DESCRIPTION OF THE PREFERRED EMBODIMENT

Figure 2:
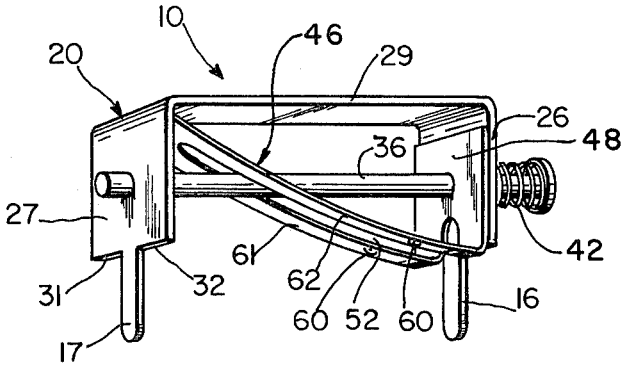
FIG. 2 is an enlarged perspective view of the electrical switch.

Referring now to the drawing in detail, an electrical switch 10 incorporating an embodiment of the present invention is shown installed on a printed circuit board 12. For that purpose, a pair of suitable conductor apertures 14 of the PC board 12 are provided for receiving a pair of parallel end tangs 16, 17 of a stamped generally U-shaped sheet metal frame 20 of the electrical switch 10. The frame 20 has a pair of parallel end walls 26, 27 and a longitudinally extending interconnecting side wall 29. Each end wall 26, 27 has a pair of outer lateral edge sections 31, 32 (FIG. 2) on opposite sides of the respective tang 16, 17 for engagement with the PC board 12 when the switch 10 is installed. The frame 20 is rigidly secured to the PC board 12 by soldering the tangs 16, 17 within their retaining apertures 14 and also if desired by soldering the frame edge sections 31, 32 to underlying conductors provided on the contiguous face of the PC board 12. The printed circuit 30 on the PC board 12 is thereby connected to one or both of the frame end walls 26, 27 to provide an electrical connection between the switch frame 20 and the PC board circuit 30. The switch 10 is useful with different PC board circuits 30 for selectively electrically connecting conductor portions of the printed circuit as desired.

Figure 3:
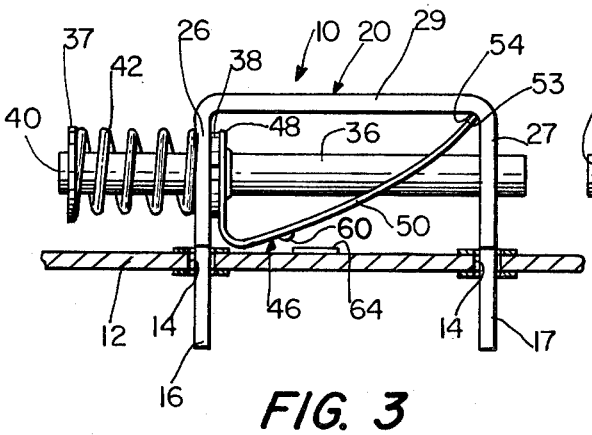
FIGS. 3 and 4 are enlarged side views, partly broken away and partly in section, of the switch installation of FIG. 1, respectively showing the switch in its open and closed conditions.
Figure 4:
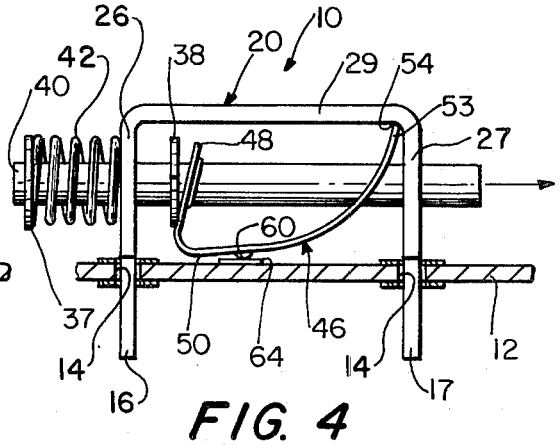

An elongated switch operating rod 36 is reciprocably mounted within aligned openings in the frame end walls 26, 27 for axial rectilinear movement parallel to the PC board 12. Suitable retaining rings 37, 38 are mounted within peripheral annuluses in the operating rod 36 at one outer end 40 of the operating rod 36 and at an intermediate point between the end walls 26, 27 and adjacent to the frame end wall 26. A coil compression spring 42 is mounted on the operating rod 36 between the end retaining ring 38 and the adjacent end wall 26 to bias the operating rod 36 outwardly, to the left as seen in FIGS. 3 and 4, to a limit position thereof limited by the engagement of the intermediate retainer ring 38 with the end wall 26.

Figure 1:
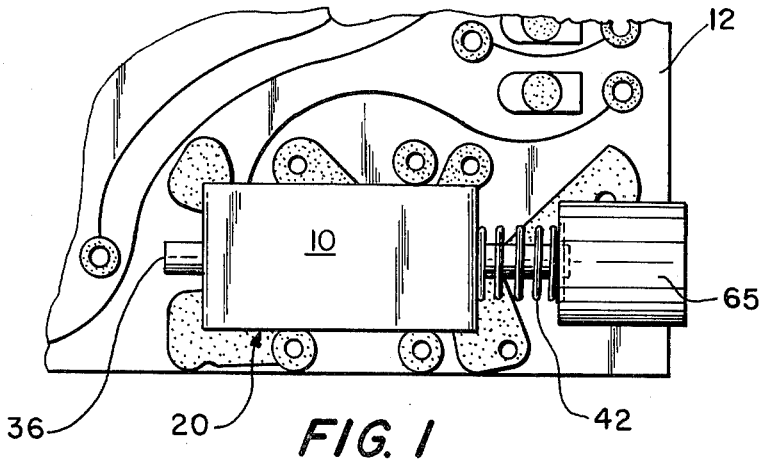
FIG. 1 is a partial plan view, partly broken away and partly in section, of an electrical switch incorporating an embodiment of the present invention installed on a printed circuit board.

A leaf spring switching element 46 having a generally L-shaped configuration in its fully relaxed state (not shown) comprises a first upstanding base portion 48 and an elongated leg portion 50. The base portion 48 has an opening loosely receiving the operating rod 36 and engages the intermediate retainer ring 38. The elongated leg portion 50 has a longitudinally extending slot 52 (FIG. 2) receiving the operating rod 36 and an outer end 53 engaging an inside corner 54 of the frame formed between the end wall 27 and the sidewall 29. In the normal or extended position of the operating rod 36 shown in FIG. 3, the elongated leg 50 is bowed or flexed slightly outwardly of the rod 36 and lies on a generally curved arc extending between the corner 54 of the frame 20 and the base 48 of the switching element 46. The elongated leg portion 50 extends in the same longitudinal direction as the opening rod 36 and is adapted to be bowed or deflected outwardly from its normal position shown in FIG. 3 by axially shifting the operating rod 36 to the right, as seen in FIG. 3. For that purpose, a push button 65 may be suitably mounted on the outer end of the rod 36 as shown in FIG. 1. Alternatively, the switch 10 may be electromagnetically or mechanically actuated as desired.

A pair of transversely aligned outwardly projecting dimples 60 are formed on the two parallel leg segments 61, 62 (FIG. 2) of the flexible leaf spring element 46 to provide electrical contacts engageable with a fixed contact 64 of the printed circuit 30. The dimples 60 are formed between the ends of the leg 50 of the flexible leaf spring relatively close to the juncture of the inner end of the leg 50 with the leaf spring base 48. When the operating rod 36 is actuated inwardly, to the right as seen in FIGS. 3 and 4, the dimple contacts 60 are displaced, by the resulting outward bowing of the leaf spring leg 50, along a sloping path having components parallel and vertical to the fixed PC board contact 64. The dimple contacts 60 of the leaf spring therefor "land" via a sloping path into sliding engagement with the fixed PC board contact 64 and have a contact force with the fixed contact 64 which is a function of the inward displacement of the operating rod 36. The outer end of the leaf spring leg 50 remains in engagement with the corner 54 of the frame to provide a good electrical connection via the frame 20 with the printed circuit 30. (Electrical connection between the leaf spring switching element 46 and the frame 20 is also provided via the spring retainer 38, rod 36, spring retainer 37 and compression spring 42.)

Therefore in accordance with the present invention, an inexpensive and reliable switch is provided for use with PC boards for selectively making electrical connection between printed circuit conductors of the PC board. Also, the switch provides both sliding contact engagement and good contact pressure and thereby ensures a good electrical connection even where a low voltage PC board circuit is employed.

As will be apparent to persons skilled in the art, various modifications, adaptations and variations of the foregoing specific disclosure can be made without departing from the teachings of the present invention.

I claim:

1. An electrical switch comprising a support, a switch operator mounted for rectilinear reciprocable movement on the support for being shifted between first and second positions thereof for operating the switch, an elongated resilient leaf spring switching element having one end engaging the support so as to permit pivotal movement thereof relative to the support and means at the other end thereof connected to the switch operator to be shifted thereby generally toward and away from said one end as the switch operator is shifted between its said first and second positions, the leaf spring switching element being bowed outwardly an amount which increases as the switch operator is shifted from its first position to its second position and having contact means intermediate its said ends and movable along an outwardly sloping path relative to the rectilinear path of movement of the switch operator as the operator is shifted from its first to its second position.

2. An electrical switch according to claim 1 wherein said means at said other end of the leaf spring switching element comprises a base portion, extending generally transversely of said path of movement of the switch operator, having an opening, the switch operator having means extending into said opening for connecting the switch operator thereto and engaging the base portion for shifting the base portion therewith.

3. An electrical switch according to claim 2 wherein the elongated leaf spring switching element comprises an elongated portion extending from the base portion and being bowed outwardly an amount which increases as the switch operator is shifted from first to its second position.

4. An electrical switch according to claim 1 wherein the switch operator is elongated and mounted for longitudinal rectilinear reciprocable movement, wherein the elongated switching element has an elongated slot, and wherein the switch operator extends longitudinally through said slot.

5. A printed circuit board switch assembly comprising a printed circuit board with a pair of spaced openings therein and a printed circuit having a circuit contact on one side of the printed circuit board intermediate said openings, a generally U-shaped switch frame with a pair of spaced generally parallel end walls with respective reduced projections received within said printed circuit board apertures respectively for mounting the switch frame on said one side of the printed circuit board with the frame end walls on opposite sides of said printed circuit contact, the spaced end walls of the frame having opposed openings, an elongated switch operator mounted within the opposed openings of the frame for being longitudinally shifted generally parallel to the printed circuit board between first and second positions thereof for operating the switch, an elongated resilient leaf spring switch element extending generally in the same longitudinal direction as the elongted operator, the elongated leaf spring switch element having means at one end thereof connected to the elongated switch operator to be longitudinally shifted therewith and having its other end in engagement with the frame so as to permit pivotal movement thereof relative to the frame, the leaf spring switch element being bowed outwardly from the elongated operator toward the printed circuit board by an amount which increases as the switch operator is shifted from its first to its second position, the elongated switch element having contact means movable along an inclined path relative to the printed circuit board into sliding engagement with the printed circuit contact as the operator is shifted from its first to its second position.

6. An electrical switch for a printed circuit board comprising a generally U-shaped switch frame with a pair of spaced legs with respective reduced projections adapted to be received within openings in a printed circuit board for mounting the switch frame on one side thereof, the spaced legs of the frame having opposed openings, an elongated switch operator mounted within the opposed openings of the frame for being longitudinally shifted between first and second positions thereof generally parallel to a printed circuit board for operating the switch, an elongated resilient leaf spring switch element extending generally in the same longitudinal direction as the elongated switch operator, the elongated leaf spring switch element having means at one end thereof connected to the elongated switch operator to be longitudinally shifted thereby and having its other end in engagement with the frame so as to permit pivotal movement thereof relative to the support, the leaf spring switch element being bowed downwardly from the elongated operator downwardly by an amount which increases as the switch operator is shifted from its first to its second position for selective engagement with a printed circuit contact of the printed circuit board, the elongated switch element having contact means movable along an outwardly inclined path relative to the longitudinal axis of the switch operator for engagement with the printed circuit contact as the operator is shifted from its first to its second position.

* * * * *